US005906023A

United States Patent [19]

Edwards

[11] Patent Number: 5,906,023

[45] Date of Patent: May 25, 1999

[54] PIVOTABLE HAIRBRUSH

[76] Inventor: David B. Edwards, 2924 Madry La., Hampton Cove, Ala. 35763

[21] Appl. No.: 08/936,959

[22] Filed: Sep. 25, 1997

[51] Int. Cl.[6] ..... A46B 7/06

[52] U.S. Cl. ..... 15/201; 15/172; 15/185

[58] Field of Search ..... 15/144.1, 172, 15/185, 201, 203

[56] References Cited

U.S. PATENT DOCUMENTS

| | | | |
|---|---|---|---|
| D. 307,217 | 4/1990 | Fong | D4/134 |
| 1,894,509 | 1/1933 | Booth | 15/201 |
| 3,152,349 | 10/1964 | Brennesholtz | 15/201 |
| 3,691,587 | 9/1972 | Makowsky | 15/172 |
| 4,691,405 | 9/1987 | Reed | 15/201 |
| 4,847,937 | 7/1989 | Gorski | 15/203 |
| 5,052,070 | 10/1991 | Klugmann | 15/186 |
| 5,095,892 | 3/1992 | Tsumura | 128/61 |
| 5,150,491 | 9/1992 | Ikemoto | 15/186 |
| 5,228,166 | 7/1993 | Gomez | 15/172 |
| 5,327,611 | 7/1994 | Balster et al. | 15/176.4 |
| 5,373,602 | 12/1994 | Bang | 15/201 |
| 5,491,866 | 2/1996 | Simonds | 15/172 |
| 5,651,158 | 7/1997 | Halm | 15/201 |
| 5,758,383 | 6/1998 | Hohlbein | 15/172 |

FOREIGN PATENT DOCUMENTS

| | | | |
|---|---|---|---|
| 393882 | 4/1924 | Germany | 15/201 |

*Primary Examiner*—Elizabeth McKane
*Assistant Examiner*—Theresa T. Snider

[57] ABSTRACT

A pivotable hairbrush for offering a hairbrush that would adjust to the contour of a user's head. The inventive device includes a pivotable head, a plurality of bristles protruding from the pivotable head, and a handle extending from one end of the pivotable head. The pivotable head includes a stationary portion and a pivotable portion wherein the pivotable portion and the plurality of bristles protruding therefrom conjointly pivot relative to the stationary portion so as to conform to the contour of the head of a user.

8 Claims, 4 Drawing Sheets

PIVOTABLE HAIRBRUSH

BACKGROUND OF THE INVENTION

1. Field of the Invention

The present invention relates to hairbrushes and more particularly pertains to a new Pivotable Hairbrush for offering a hairbrush that would adjust to the contour of a user's head.

2. Description of the Prior Art

The use of hairbrushes is known in the prior art. More specifically, hairbrushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art hairbrushes include U.S. Pat. No. 4,847,937; U.S. Pat. No. 5,327,611; U.S. Pat. No. D307,217; U.S. Pat. No. 5,095,892; U.S. Pat. No. 5,150,491 and U.S. Pat. No. 5,052,070.

While these devices fulfill their respective, particular objectives and requirements, the aforementioned patents do not disclose a new Pivotable Hairbrush. The inventive device includes a pivotable head, a plurality of bristles protruding from the pivotable head, and a handle extending from one end of the pivotable head. The pivotable head includes a stationary portion and a pivotable portion wherein the pivotable portion and the plurality of bristles protruding therefrom conjointly pivot relative to the stationary portion so as to conform to the contour of the head of a user.

In these respects, the Pivotable Hairbrush according to the present invention substantially departs from the conventional concepts and designs of the prior art, and in so doing provides an apparatus primarily developed for the purpose of offering a hairbrush that would adjust to the contour of a user's head.

SUMMARY OF THE INVENTION

In view of the foregoing disadvantages inherent in the known types of hairbrushes now present in the prior art, the present invention provides a new Pivotable Hairbrush construction wherein the same can be utilized for offering a hairbrush that would adjust to the contour of a user's head.

The general purpose of the present invention, which will be described subsequently in greater detail, is to provide a new Pivotable Hairbrush apparatus and method which has many of the advantages of the hairbrushes mentioned heretofore and many novel features that result in a new Pivotable Hairbrush which is not anticipated, rendered obvious, suggested, or even implied by any of the prior art hairbrushes, either alone or in any combination thereof.

To attain this, the present invention generally comprises a pivotable head, a plurality of bristles protruding from the pivotable head, and a handle extending from one end of the pivotable head. The pivotable head includes a stationary portion and a pivotable portion wherein the pivotable portion and the plurality of bristles protruding therefrom conjointly pivot relative to the stationary portion so as to conform to the contour of the head of a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Pivotable Hairbrush apparatus and method which has many of the advantages of the hairbrushes mentioned heretofore and many novel features that result in a new Pivotable Hairbrush which is not anticipated, rendered obvious, suggested, or even implied by any of the prior art hairbrushes, either alone or in any combination thereof.

It is another object of the present invention to provide a new Pivotable Hairbrush which may be easily and efficiently manufactured and marketed.

It is a further object of the present invention to provide a new Pivotable Hairbrush which is of a durable and reliable construction.

An even further object of the present invention is to provide a new Pivotable Hairbrush which is susceptible of a low cost of manufacture with regard to both materials and labor, and which accordingly is then susceptible of low prices of sale to the consuming public, thereby making such Pivotable Hairbrush economically available to the buying public.

Still yet another object of the present invention is to provide a new Pivotable Hairbrush which provides in the apparatuses and methods of the prior art some of the advantages thereof, while simultaneously overcoming some of the disadvantages normally associated therewith.

Still another object of the present invention is to provide a new Pivotable Hairbrush for offering a hairbrush that would adjust to the contour of a user's head.

Yet another object of the present invention is to provide a new Pivotable Hairbrush which includes a pivotable head, a plurality of bristles protruding from the pivotable head, and a handle extending from one end of the pivotable head. The pivotable head includes a stationary portion and a pivotable portion wherein the pivotable portion and the plurality of bristles protruding therefrom conjointly pivot relative to the stationary portion so as to conform to the contour of the head of a user.

Still yet another object of the present invention is to provide a new Pivotable Hairbrush that could be easily maneuvered through hair for better styling techniques.

Even still another object of the present invention is to provide a new Pivotable Hairbrush that would allow a person to brush and style hair with greater control and flexibility.

Even still another object of the present invention is to provide a new Pivotable Hairbrush that would contour to the shape of a user's head and would massage the scalp.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
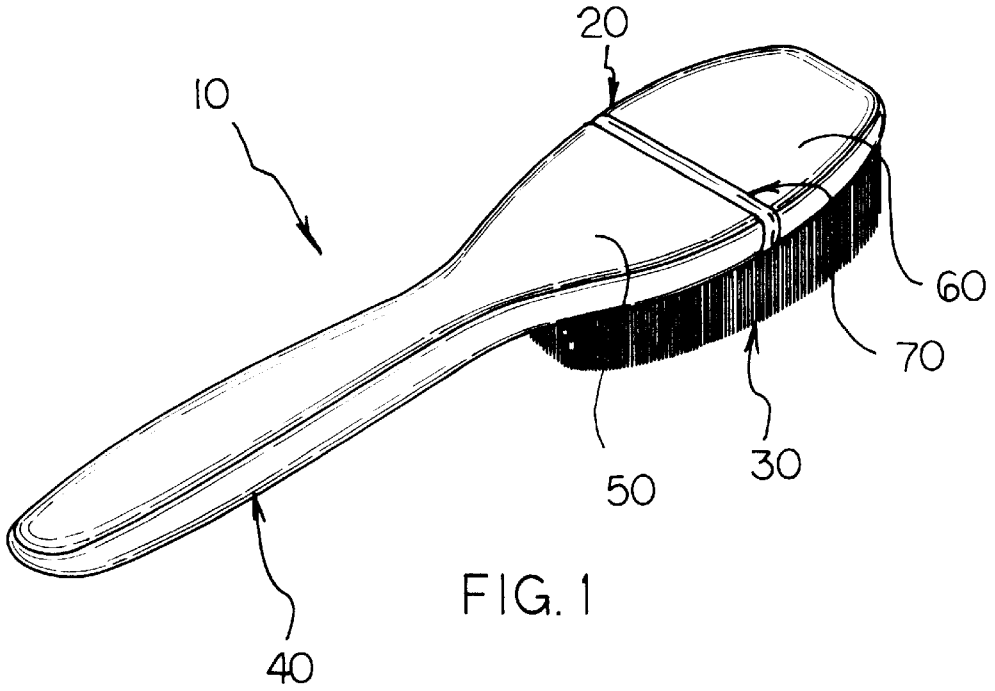
FIG. 1 is a perspective view of a new Pivotable Hairbrush according to the present invention.
Figure 2:
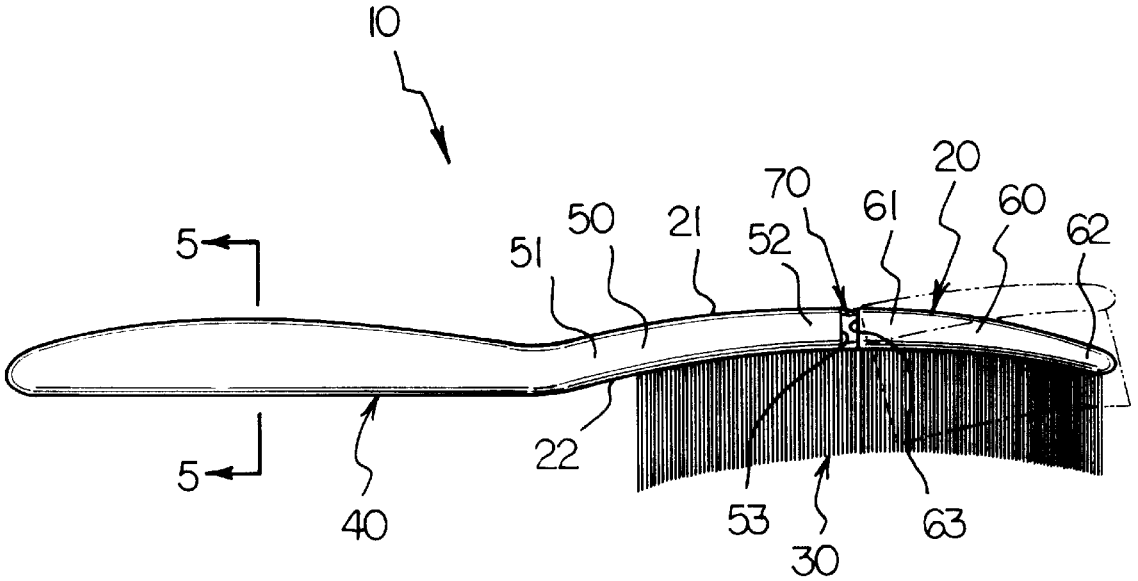
FIG. 2 is a side view of the present invention.

With reference now to the drawings, and in particular to FIGS. 1 through 8 thereof, a new Pivotable Hairbrush embodying the principles and concepts of the present invention and generally designated by the reference numeral 10 will be described.

More specifically, it will be noted that the Pivotable Hairbrush 10 comprises a pivotable head 20, a plurality of bristles 30 protruding from the pivotable head 20, and a handle 40 extending from one end of the pivotable head 20. The pivotable head 20 includes a stationary portion 50 and a pivotable portion 60 wherein the pivotable portion 60 and the plurality of bristles 30 protruding therefrom conjointly pivot relative to the stationary portion 50 so as to conform to the contour of the head of a user.

Figure 4:
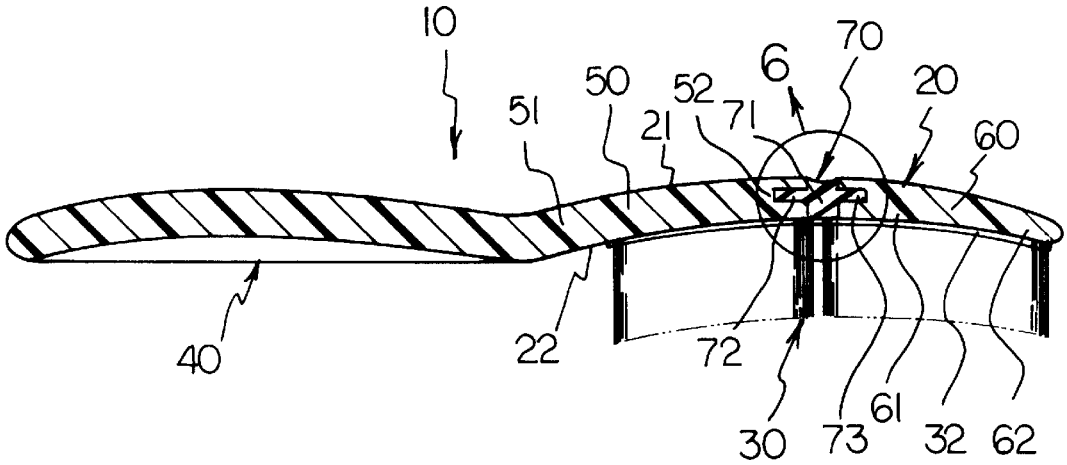
FIG. 4 is a cross sectional view taken along line 4—4 of FIG. 3.
Figure 3:
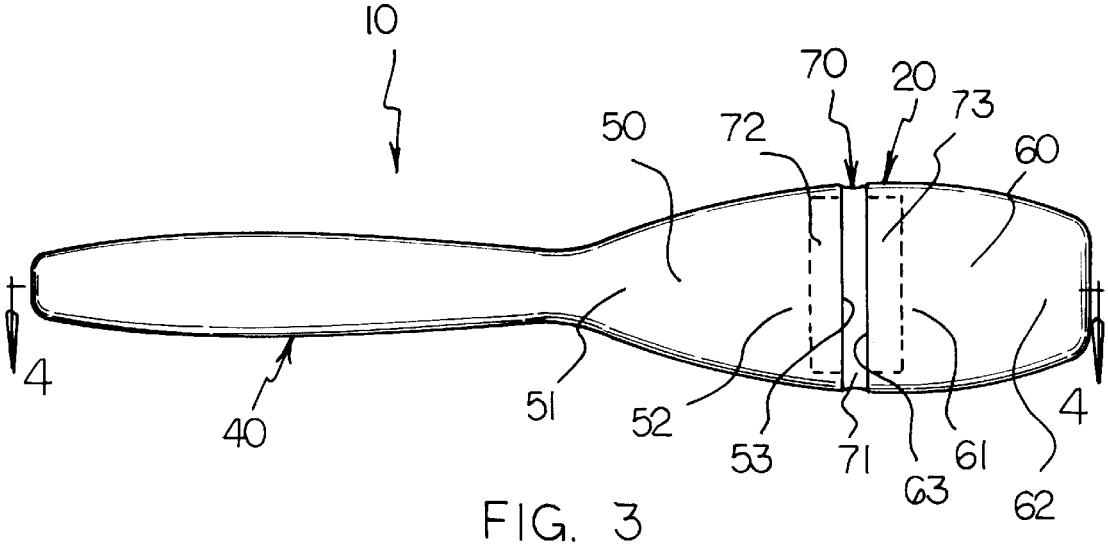
FIG. 3 is a top view of the present invention.
Figure 5:
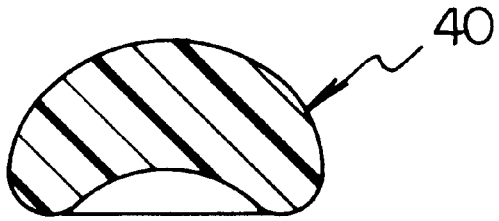
FIG. 5 is a cross sectional view taken along line 5—5 of FIG. 2.

As best illustrated in FIGS. 1 and 4, it can be shown that the pivotable head 20 has a top surface 21 and a bottom surface 22 wherein the plurality of bristles 30 protrude from the bottom surface 22 thereof. A flexible membrane 32 is disposed along the bottom surface 22 of the pivotable head 20 and flexes when the pivotable head 20 is pivoted. The plurality of bristles 30 protrude from the flexible membrane 32 whereby the plurality of bristles 30 pivot with the pivotable head 20 and thereby contour to the head of a user.

The pivotable head 20 comprises a stationary portion 50, a pivotable portion 60, and a pivotable connector 70 pivotably connecting the pivotable portion 60 to the stationary portion 50. As such, the pivotable portion 60 is allowed to pivot upwards and downwards relative to a longitudinal axis of the stationary portion 50 along a transverse axis of the pivotable head 20. The handle 40 extends from the stationary portion 50 of the pivotable head 20.

The stationary portion 50 and the pivotable portion 60 each have a first end 51 and 61, respectively, and a second end 52 and 62, respectively. Accordingly, the handle 40 extends from the first end 51 of the stationary portion 50. In a preferred embodiment, the second end 52 of the stationary portion 50 substantially parallels the first end 61 of the pivotable portion 60. In addition, the second end 52 of the stationary portion 50 and the first end 61 of the pivotable portion 60 each have an end surface 53 and 63, respectively. Each end surface 53 and 63 has a transverse groove 54 and 64, respectively, therein. The transverse groove 54 provided in the stationary portion 50 substantially traverses the end surface 53 thereof and the transverse groove 64 provided in the pivotable portion 60 substantially traverses the end surface 63 thereof.

Figure 6:
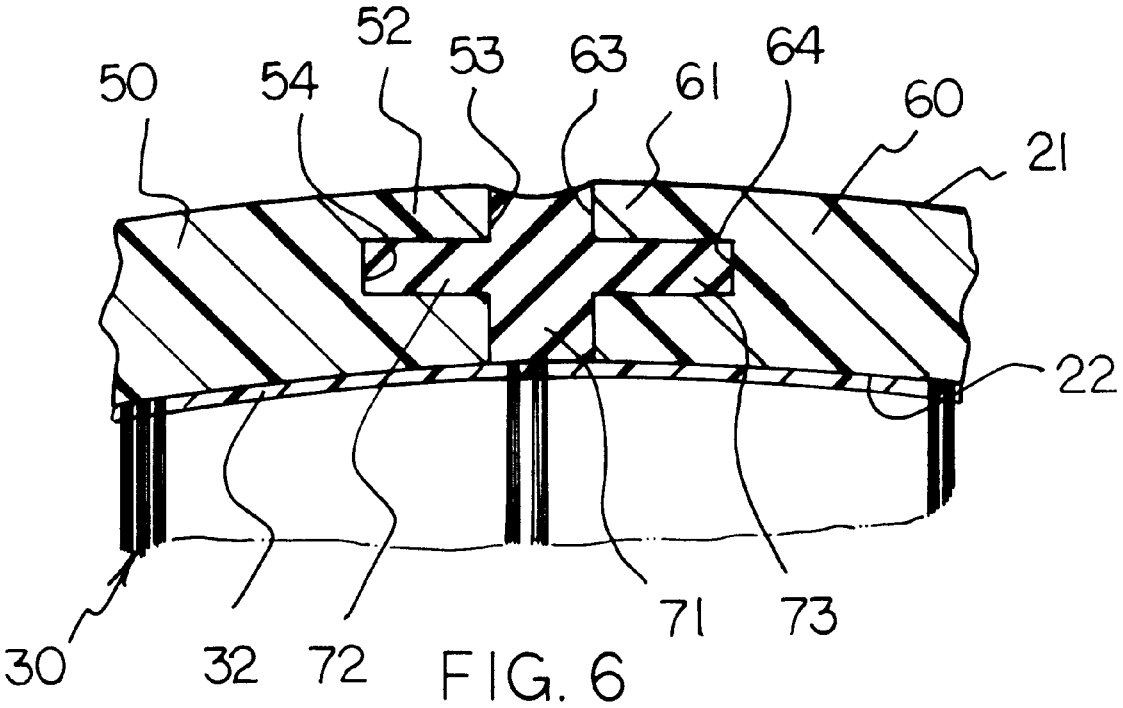
FIG. 6 is an enlarged illustration of area 6 of FIG. 4.

In a preferred embodiment, best illustrated in FIGS. 4 and 6, it can be shown that the pivotable connector 70 comprises a flexible member 71 secured to each the stationary portion 50 and the pivotable portion 60. The flexible member 71 includes a first fin 72 perpendicularly extending from one side thereof and a second fin 73 perpendicularly extending from an opposite side thereof. As such, the first fin 72 matingly engages and fits within the transverse groove 54 provided in the end surface 53 of the stationary portion 50 and the second fin 73 matingly engages and fits within the transverse groove 64 provided in the end surface 63 of the pivotable portion 60. Preferably, the flexible member 71 is formed of a resilient material. Accordingly, the flexible member 71 pivotally connects the pivotable portion 60 to the stationary portion 50.

Figure 7:
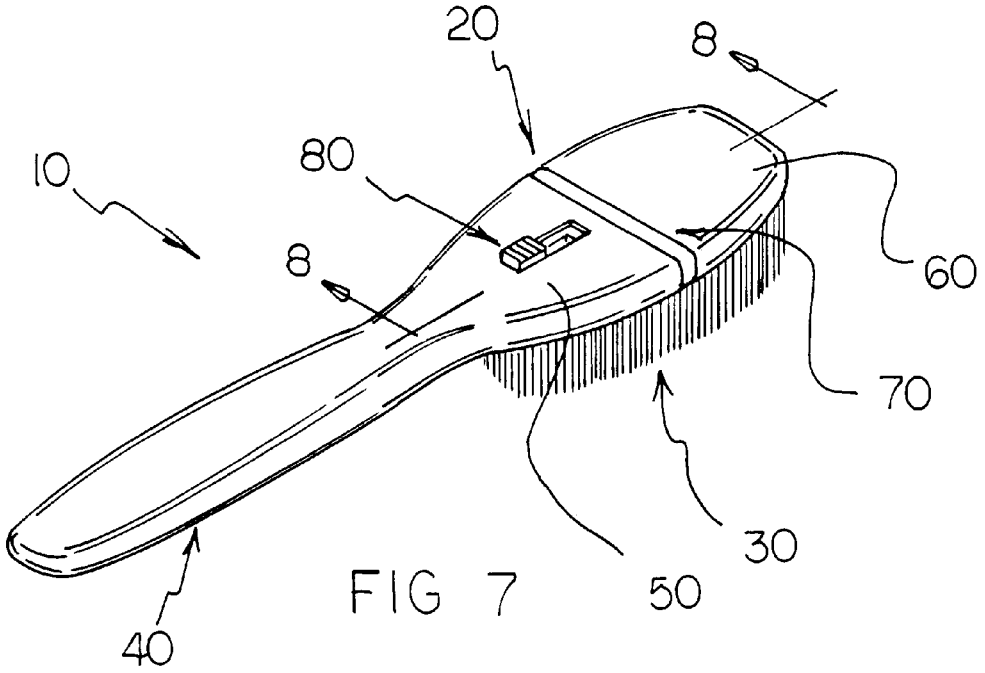
FIG. 7 is a perspective view of an optional embodiment of the present invention illustrating the locking mechanism.
Figure 8:
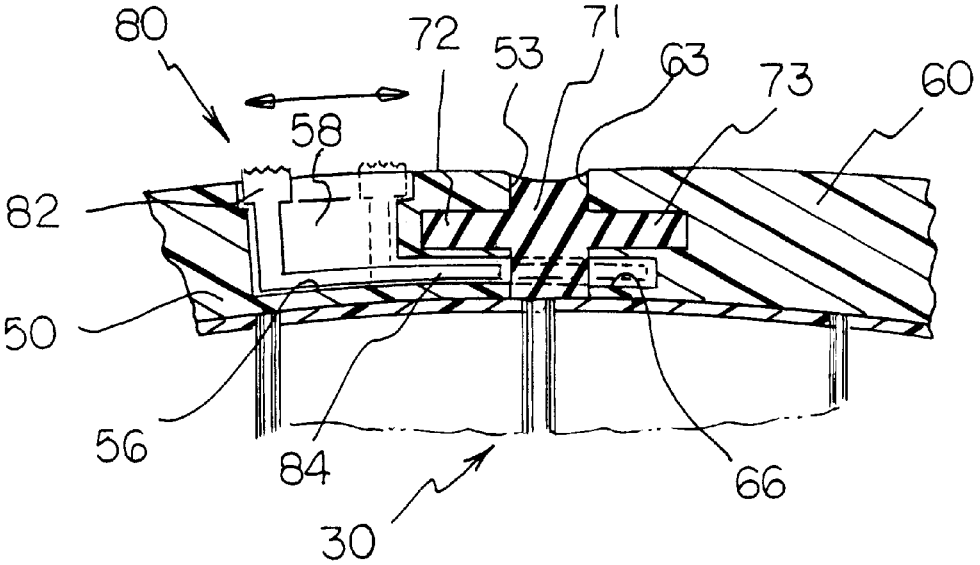
FIG. 8 is cross sectional view taken along line 8—8 of FIG. 7.

In an optional embodiment, best illustrated in FIGS. 7 and 8, it can be shown that the Pivotable Hairbrush 10 includes a locking mechanism 80 for selectively locking the pivotable head 20 in a fixed position. Preferably, the locking mechanism 80 includes a locking button 82 and a locking arm 84 extending from the locking button 82 so as to form a generally L-shaped configuration. Accordingly, the locking button 82 is used to selectively extend and retract the locking arm 84 into and from a locking slot 66 provided in the end surface 63 of the pivotable portion 60 of the pivotable head 20.

The locking arm 84 is slidably positioned within a retention slot 56 provided in the stationary portion 50 of the pivotable head 20. The retention slot 56 is open to the end surface 53 of the stationary portion 50 and is aligned with the locking slot 66 provided in the pivotable portion 60. Accordingly, the locking button 82 extends through a slit 58 provided in the stationary portion 50 of the pivotable head 20. The slit 58 is provided in the top surface 21 of the pivotable head 20 and communicates with the retention slot 56. As such, the locking button 82 is slidable between a first position and a second position. In the first position, the locking arm 84 is extended into the locking slot 66 so as to prohibit pivoting of the pivotable portion 60 relative to the stationary portion 50. In the second position, the locking arm 84 is retracted from the locking slot 66 so as to permit pivoting of the pivotable portion 60 relative to the stationary portion 50.

In use, a user grasps the handle 40 and brushes their hair with the plurality of bristles 30 protruding from the pivotable head 20. As such, the pivotable portion 60 of the pivotable head 20 pivots relative to the stationary portion 50 such that the plurality of bristles 30 pivot and contour to the head of a user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A pivotable hairbrush, comprising:

a pivotable head having a top surface and a bottom surface;

a plurality of bristles protruding from said bottom surface of said pivotable head, said plurality of bristles pivoting with said pivotable head and contouring to the head of a user;

a handle extending from one end of said pivotable head;

said pivotable head comprising a stationary portion, a pivotable portion, and a pivotable connection means for pivotably connecting said pivotable portion to said stationary portion;

said pivotable portion being pivotable upwards and downwards relative to a longitudinal axis of said stationary portion;

said pivotable connection means comprising a flexible member having a first fin perpendicularly extending from one side thereof and a second fin perpendicularly extending from an opposite side thereof, said fins engaging transverse grooves in said pivotable portion and said stationary portion; and a locking means for selectively locking said pivotable portion of said pivotable head in a fixed, non-pivotable position.

2. The pivotable hairbrush of claim 1, wherein said handle extends from said stationary portion of said pivotable head.

3. The pivotable hairbrush of claim 2, wherein said stationary portion and said pivotable portion etch have a first end and a second end, said second end of said stationary portion substantially paralleling said first end of said pivotable portion, said second end of said stationary portion and said first end of said pivotable portion each having an end surface, a end surface having a transverse groove formed therein, wherein said handle extends from said first end of said stationary portion.

4. The pivotable hairbrush of claim 2, wherein said stationary portion of said pivotable head has a first end and a second end, said handle extending from said first end of said stationary portion, said second end of said stationary portion having an end surface, said end surface of said stationary portion having said transverse groove formed therein, wherein said pivotable portion of said pivotable head has a first end and a second end, said first end of said pivotable portion having an end surface, said end surface of said pivotable portion having said transverse groove formed therein, and wherein said flexible member is formed of resilient material.

5. A pivotable hairbrush comprising:

a pivotable head having a top surface and a bottom surface;

a plurality of bristles protruding from said bottom surface of said pivotable head, said plurality of bristles pivoting with said pivotable head and contouring to the head of a user; and a handle extending from one end of said pivotable head;

wherein said pivotable head comprises:

a stationary portion, a pivotable portion, and a pivotable connection means for pivotably connecting said pivotable portion to said stationary portion whereby said pivotable portion is pivotable upwards and downwards relative to a longitudinal axis of said stationary portion, and wherein said handle extends from said stationary portion of said pivotable head;

said stationary portion and said pivotable portion each having a first end and a second end, said second end of said stationary portion substantially paralleling said first end of said pivotable portion, said second end of said stationary portion and said first end of said pivotable portion each having an end surface, said end surface having a transverse groove therein;

wherein said handle extends from said first end of said stationary portion;

said pivotable connection means comprising:

a flexible member including a first fin perpendicularly extending from one side thereof and a second fin perpendicularly extending from an opposite side thereof, and said first fin engagingly fitting within said transverse groove provided in said end surface of said stationary portion and said second fin engagingly fitting within said transverse groove provided in said end surface of said pivotable portion whereby said flexible member pivotally connects said pivotable portion to said stationary portion; and a locking means for selectively locking said pivotable portion of said pivotable head in a fixed, non-pivotable position.

6. The pivotable hairbrush of claim 5, wherein said locking means comprises:

a locking slot provided in said end surface of said pivotable portion of said pivotable head, a retention slot provided in said stationary portion of said pivotable head, said retention slot open to said end surface of said stationary portion and aligned with said locking slot provided in said end surface of said pivotable portion, a slit provided in said stationary portion of said pivotable head, said slit provided in said top surface of said pivotable head and communicating with said retention slot, a locking button having a lower end extending through said slit, and a locking arm perpendicularly extending from said lower end of said locking button, said locking arm slidably positioned within said retention slot whereby said locking button is used to selectively extend and retract said locking arm into and from said locking slot provided in said end surface of said pivotable portion of said pivotable head.

7. A pivotable hairbrush, comprising:

a pivotable head having a top surface and a bottom surface, said pivotable head including a stationary portion and a pivotable portion;

a handle extending from said stationary portion of said pivotable head;

a plurality of bristles protruding from said bottom surface of said pivotable head, said pivotable portion and said plurality of bristles protruding therefrom pivoting in use relative to said stationary portion so as to conform to the profile of the head of a user;

a pivotable connection means for pivotably connecting said pivotable portion to said stationary portion whereby said pivotable portion is pivotable upwards and downwards relative to a longitudinal axis of said stationary portion along a transverse axis of said pivotable head;

said stationary portion of said pivotable head has a first end and a second end, said handle extending from said first end of said stationary portion, said second end of said stationary portion having an end surface, said end surface of said stationary portion having a transverse groove therein;

wherein said pivotable portion of said pivotable head has a first end and a second end, said first end of said pivotable portion having an end surface, said end surface of said pivotable portion having a transverse groove therein;

said pivotable connection means comprising a flexible member formed of a resilient material, said flexible member including a first fin perpendicularly extending from one side thereof and a second fin perpendicularly extending from an opposite side thereof, said first fin fitting within said transverse groove provided in said end surface of said second end of said stationary portion and said second fin fitting within said transverse groove provided in said end surface of said first end of said pivotable portion; and a locking means for selectively locking said pivotable portion of said pivotable head in a fixed, non-pivotable position.

8. The pivotable hairbrush of claim 7, wherein said pivotable portion of said pivotable head has a locking slot provided in said end surface thereof, wherein said stationary portion of said pivotable head has a retention slot provided therein, said retention slot open to said end surface of said stationary portion and aligned with said locking slot provided in said end surface of said pivotable portion, wherein said stationary portion of said pivotable head has a slit provided in said top surface thereof, said slit communicating with said retention slot, and wherein said locking means comprises:

a locking button having a lower end extending through said slit, and a locking arm perpendicularly extending from said lower end of said locking button, said locking arm slidably positioned within said retention slot whereby said locking button is slidable between a first position wherein said locking arm is extended into said locking slot so as to prohibit pivoting of said pivotable portion relative to said stationary portion and a second position wherein said locking arm is retracted from said locking slot so as to permit pivoting of said pivotable portion relative to said stationary portion.

* * * * *